US005623984A

United States Patent [19]

Nozaki et al.

[11] Patent Number: 5,623,984

[45] Date of Patent: Apr. 29, 1997

[54] METHOD OF CONTROLLING PRESSURIZING PIN AND CASTING APPARATUS WITH PRESSURIZING PIN CONTROLLER

[75] Inventors: Mikiya Nozaki, Toyota; Mitsuhiro Karaki, Okazaki; Mitsuru Inui, Gifu-ken; Takehito Futamura; Akira Saitoh, both of Gifu, all of Japan

[73] Assignees: Toyota Jidosha Kabushiki Kaisha, Toyota; Gifu Seiki Kogyo Kabushiki Kaisha, Tokyo, both of Japan

[21] Appl. No.: 494,260

[22] Filed: Jun. 23, 1995

[30] Foreign Application Priority Data

Jun. 29, 1994 [JP] Japan ..... 6-148017

[51] Int. Cl.[6] ..... B22D 27/11

[52] U.S. Cl. ..... 164/457; 164/120

[58] Field of Search ..... 164/120, 319, 164/320, 4.1, 154.1, 154.2, 155.4, 457

[56] References Cited

U.S. PATENT DOCUMENTS

| | | |
|---|---|---|
| 4,380,261 | 4/1983 | Suzuki et al. . |
| 4,844,146 | 7/1989 | Kikuchi et al. . |
| 4,932,458 | 6/1990 | Iwamoto et al. . |
| 5,161,598 | 11/1992 | Iwamoto et al. . |

FOREIGN PATENT DOCUMENTS

| | | | |
|---|---|---|---|
| 0295831 | 12/1988 | European Pat. Off. . | |
| 0361837 | 4/1990 | European Pat. Off. . | |
| 0481413 | 4/1992 | European Pat. Off. . | |
| 57-127569 | 8/1982 | Japan . | |
| 3-275263 | 12/1991 | Japan | 164/457 |
| 4-182053 | 6/1992 | Japan . | |
| 5-161952 | 6/1993 | Japan | 164/154.2 |

*Primary Examiner*—Kuang Y. Lin

*Attorney, Agent, or Firm*—Oblon, Spivak, McClelland, Maier & Neustadt, P.C.

[57] ABSTRACT

The disclosed method of controlling a pressurizing pin, which serves to replenish for the necessary locality with molten metal during solidification of molten metal charged in the cavity, features that the operation of the molten metal replenishment by the pressurizing pin is caused when it is detected that the volume of non-solidified metal has become less than the volume effective for obtaining a molten metal replenishment effect. It is thus possible to obtain efficient replenishment for the necessary locality with molten metal by using a pressurizing pin which is limited in size and stroke.

7 Claims, 5 Drawing Sheets

METHOD OF CONTROLLING PRESSURIZING PIN AND CASTING APPARATUS WITH PRESSURIZING PIN CONTROLLER

BACKGROUND OF THE INVENTION

1. Field of the Invention

This invention relates to a technique of effectively replenishing a locality where molten metal is being solidified in a die cavity with molten metal by advancing a pressurizing pin into the cavity, thus preventing a shrinkage cavity or like die casting defect that may otherwise be generated in the cast product as a result of shrinkage of metal attendant upon solidification thereof.

2. Description of the Prior Art

A prior art technique pertaining to this technique is disclosed in Japanese Laid-Open Patent Publication No. 57-127569.

In this technique, until solidification of molten metal charged in a die cavity is completed, the die cavity is continuously replenished with molten metal in an extrusion molten metal chamber by an extruding pin, and also the die cavity is continuously replenished with molten metal in a pressurized molten metal chamber by a pressurizing pin.

In this technique, molten metal charged in the die cavity is solidified in a state that a locality where molten metal is being solidified is continuously replenished with molten metal, thus preventing shrinkage cavity or like die casting defect.

In this prior art method, however, the die cavity is continuously replenished with molten metal from the commencement till the completion of the solidification of molten metal in the die cavity. Therefore, the extruding pin and the pressurizing pin should have capacity (i.e., size and stroke) sufficient for the continuous replenishment with molten metal. That is, there is a problem that the extruding pin and the pressurizing pin become large in size. In addition, it is sometimes difficult to secure sufficient stroke or size of the pins depending on the shape of the cast product. In die casting, the possibility of generation of die casting defects is increased in a latter stage of solidifying step. This poses a difficulty of manufacture of a cast product in which the die casting quality of parts which are solidified in the latter stage of the solidifying step is significant.

A technique for coping with the problem noted above is disclosed in Japanese Laid-open Patent Publication No. 4-182053. In this technique, a pressurizing pin is advanced at a low speed into a die cavity with molten metal charged therein, and during this time, the force that is required for the continuous low speed advancement of the pressurizing pin is continuously detected. Upon reaching of a predetermined value by the detected force, the speed of advancement of the pressurizing pin is increased. According to this technique, the status of process of solidification can be grasped from the force necessary for the continuous low speed advancement of the pressurizing pin.

While there is no substantial progress of solidification, the shrinkage of molten metal attendant upon the solidification is not so much, and the molten metal replenishment by the pressurizing pin is not necessary. On the other hand, when the replenishment with molten metal by the pressurizing pin is commenced after excessive progress of solidification, there is al ready shrinkage defect generated as a result of solidification. According to the disclosed technique described above, the status of progress of solidification is grasped by causing continuous slow advancement of the pressurizing pin. It is thus possible to replenish with molten metal during the solidification by advancing the pressurizing pin at an adequate timing which is neither too early nor too late.

However, carrying out this prior art technique proves that proper correspondence cannot always be obtained between the force necessary for the continuous slow advancement of the pressurizing pin and the solidification progress status. In other words, even with this system, it is frequently the case that the pressurizing pin advancement timing for the replenishment is too early or too late. In addition, the control of the advancement speed during low speed advancement is very much sophisticated. If the speed is insufficient, the solidification progress status cannot be detected satisfactorily. If the speed is excessive, on the other hand, a major proportion of the advancement stroke of the pressurizing pin has been used in the detection of the optimum timing. That is, it may occur that the pressurizing pin can no longer be advanced when the molten metal replenishment action is really necessary.

SUMMARY OF THE INVENTION

One object of the invention is to provide a more adequate timing of the molten metal replenishment action by the pressurizing pin by permitting detection of a quantity which corresponds more satisfactorily to the solidification progress status. The inventor conducted extensive experiments and confirmed that so long as the dynamic process of quantity detection while causing advancement of the pressurizing pin is adopted, the detected value is greatly affected by the viscosity and material quality of the molten metal and other factors as well as the solidification progress status, thus making accurate detection difficult. Meanwhile, it was found that satisfactory correspondence between the detected value and the solidification progress status is obtainable by permitting the quantity detection with the pressurizing pin held stationary. Molten metal in cavity is solidified from its periphery, from which heat can be readily robbed by the die. Thus, the periphery is first solidified to wrap non-solidified metal inside. As the solidification proceeds, the region or volume of the non-solidified metal gradually becomes smaller. During this time, a physical quantity which is directly or indirectly related to the volume of the non-solidified metal is detected with the pressurizing pin held stationary. With the detection of the physical quantity as an index, the molten metal replenishment by the pressurizing pin is executed. By so doing, the problem inherent in the prior art technique described above can be solved. In other words, it is possible to obtain molten metal replenishment action by the pressurizing pin steadily at a timing which is neither too early nor too late.

What may be detected as physical quantity related to the volume of the non-solidified metal is an increase of reaction force acted on the pressurizing pin from the cavity side when the pressurizing pin is advanced to an extent corresponding to a predetermined length. This reaction force increase is closely related to the volume of the non-solidified metal. The smaller the volume of the non-solidified metal, the greater is the increase. Conversely, the greater the volume of the non-solidified metal, the smaller is the increase. A different physical quantity that may be detected is an increase of the extent of advancement of the pressurizing pin that is caused when the pressure applied to the pressurizing pin is increased by a predetermined amount. This quantity again is closely related to the volume of the non-solidified metal. In this case, the smaller the volume of the non-solidified metal, the smaller is the increase, and the greater the volume of the non-solidified metal, the greater is the increase.

Another object of the invention is to ensure a sufficient stroke of the pressurizing pin for the molten metal replenishment action. To this end, according to the invention, the pressurizing pin is once moved and then held stationary, and it is returned to the initial position after detection of the physical quantity related to the volume of the non-solidified metal. With this arrangement, there is no possibility that the stroke of the pressurizing pin is used up while the solidification progress status of molten metal is detected using the pressurizing pin, and a sufficient stroke of the pressurizing pin can be ensured when the molten metal replenishment by the pressurizing pin is necessary.

The above and other objects, Features and advantages of the invention will become more fully apparent from the detailed description of the preferred embodiments and the claims when the same is read with reference to the accompanying drawings.

DETAILED DESCRIPTION OF THE PREFERRED EMBODIMENTS

Now, a method of controlling a pressurizing pin and a die casting apparatus with a pressurizing pin embodying the invention will be described with reference to FIGS. 1(A) to 1(C), 2(A), 2(B), 3, 4, and 5(A) to 5(C).

Figure 4:
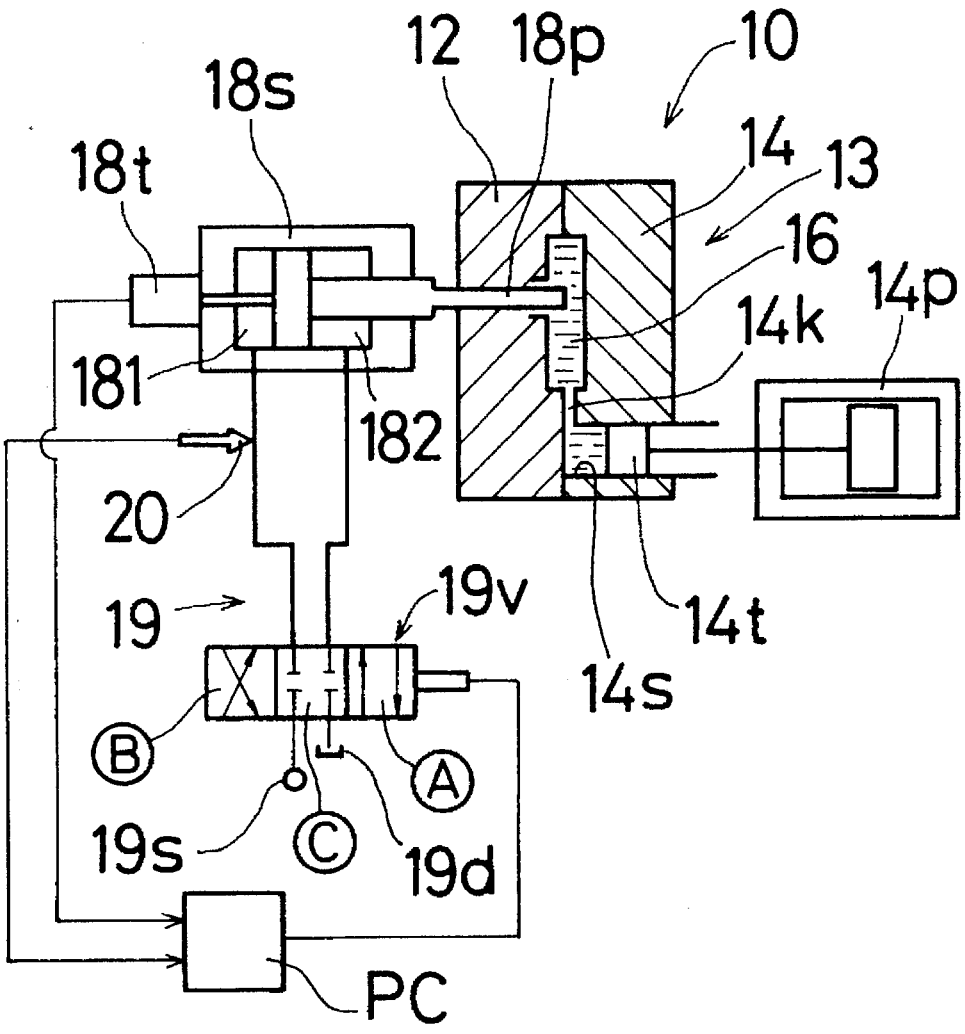
FIG. 4 is a schematic representation of the essential parts of a die casting machine used in the embodiment of the invention.
Figures 5A, 5B, 5C:
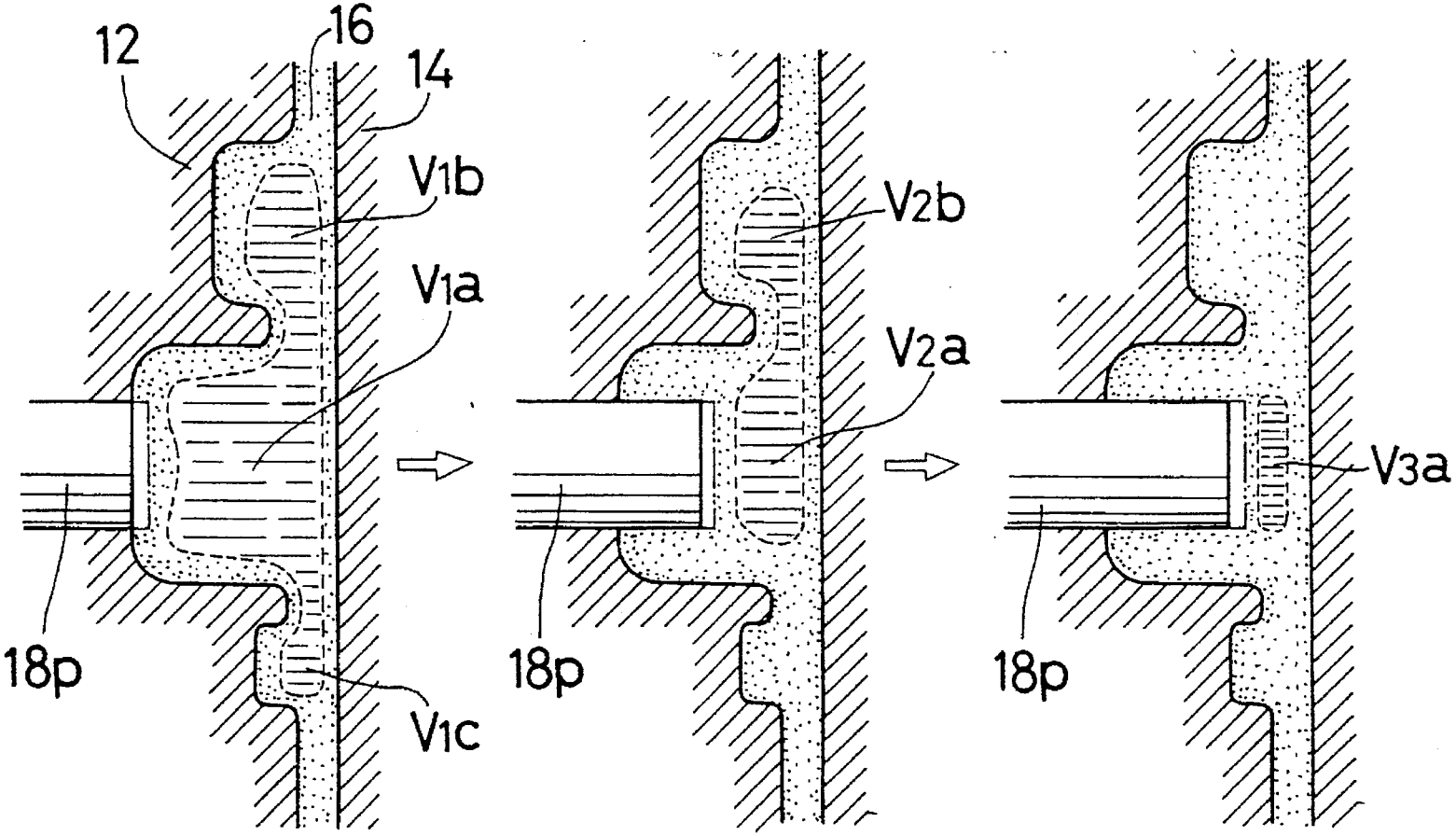
FIGS. 5(A) to 5(C) are views schematically illustrating a pressurizing pin control method according to another embodiment of the invention.

FIG. 4 shows the essential parts of a die casting machine 10 used in the embodiment. The die casting machine 10 comprises a die 13 including a movable and a stationary die half 12 and 14. In the closed state of the die 10, a die cavity 16 is formed as product forming space in the die 13. The stationary die half 14 has an extruding sleeve 14*s*. The extruding sleeve 14*s* is communicated via a gate 14*k* with the cavity 16. In the extruding sleeve 14*s*, a plunger 14*t* is inserted such that it is axially slidable. The plunger 14*t* serves to force molten metal having been supplied to the extruding sleeve 14*s* into the cavity 16. The plunger 14*t* is driven by an extruding cylinder 14*p* for axial movement along the extruding sleeve 14*s*.

In the movable die half 12, a pressurizing pin 18*p* is fitted such that it is substantially at right angles to the cavity 16. The pressurizing pin 18*p* serves to replenish a locality where molten metal charged in the die cavity 16 is being solidified. The pressurizing pin 18*p* penetrates a wall of the die 13 defining the cavity 16, and is disposed in a large thickness or depth portion of the cavity 16. As the pressurizing pin 18*p* is driven axially by an oil hydraulic cylinder 18*s*, its free end can be advanced into the cavity 16, bringing some molten metal away to replenish for a predetermined cavity locality. The axial position of the pressurizing pin 18*p* can be measured by a stroke sensor (or potentiometer) 18*t* mounted on the oil hydraulic cylinder 18*s*. The output signal of the stroke sensor 18*t* is inputted into a computer PC and is used for controlling the pressurizing pin 18*p*.

The oil hydraulic cylinder 18*s* is operated by an oil hydraulic circuit 19 including an oil hydraulic pressure generator 19*s*, a pressure release terminal 19*d* and a directional control valve 19*v*. The oil hydraulic pressure generator 19*s*, the directional control valve 19*v* and so forth constituting the oil hydraulic circuit 19 are controlled by the computer PC. The computer PC, the valve 19*v*, etc. constitute a controller for controlling the pressurizing pin 18*p*.

The oil hydraulic cylinder 18*s*has first and second oil hydraulic chambers 181 and 182. When the directional control valve 19*v* is switched to the A position, the first oil hydraulic chamber 181 is communicated with the oil hydraulic pressure generator 19*s*, while the second oil hydraulic chamber 182 is communicated with the pressure release terminal 19*d*. As a result, the oil hydraulic cylinder 18*s*is operated in a direction of pushing (i.e., in a direction of causing advancement of) the pressurizing pin 18*p* into the cavity 16. An applied pressure sensor 20 is provided on an oil hydraulic duct line communicating with the first oil hydraulic chamber 181. The applied pressure sensor 20 detects the pressure in the first oil hydraulic chamber 181, and its output signal is inputted to the computer PC. The computer PC can calculate, from the pressure in the first oil hydraulic chamber 181, the elastic reaction force that is received by the pressurizing pin 18*p* from molten metal. The pressure in the first oil hydraulic chamber 181 can be controlled by the computer PC such as to balance the extruding pressure P of molten metal and the applied pressure of the pressurizing pin 18*p* with each other.

When the directional control valve 19*v* is switched to the B position, the first oil hydraulic chamber 181 is communicated with the pressure release terminal 19*d*, while the second oil hydraulic chamber 182 is communicated with the oil hydraulic pressure generator 19*s*. As a result, the oil hydraulic cylinder 18*s*is operated in a direction of withdrawing (i.e., a direction of causing retreat of) the pressurizing pin 18*p* from the cavity 16. When the directional control valve 19*v* is switched to the C position, the first and the second oil hydraulic chambers 181 and 182 are blocked against communication with the oil hydraulic pressure generator 19*s* and the pressure release terminal 19*d*. The pressurizing pin 18*p* is thus held at this position when the valve 19*v* is switched to the C position.

Figures 1A, 1B, 1C:
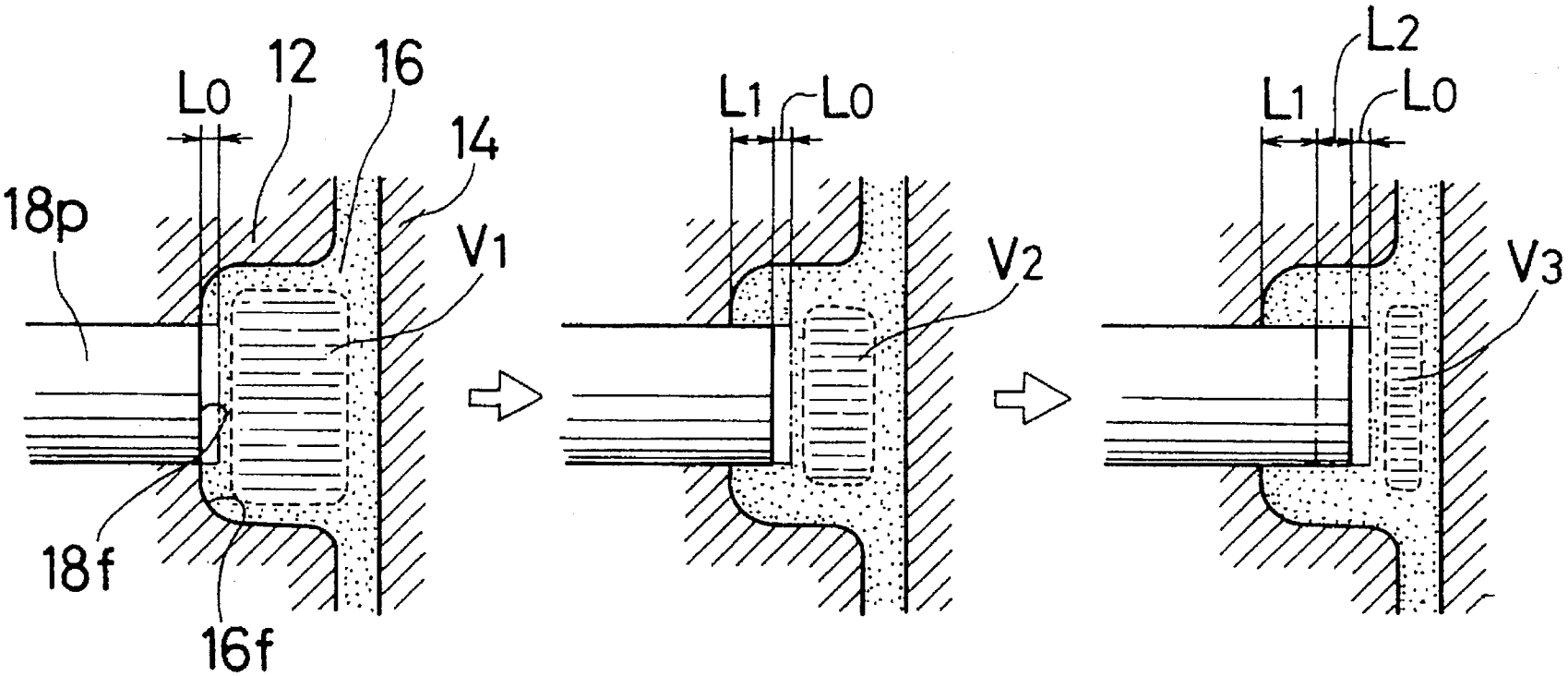
FIGS. 1(A) to 1(C) are views schematically illustrating a pressurizing pin control method according to an embodiment of the invention.
Figure 2A:
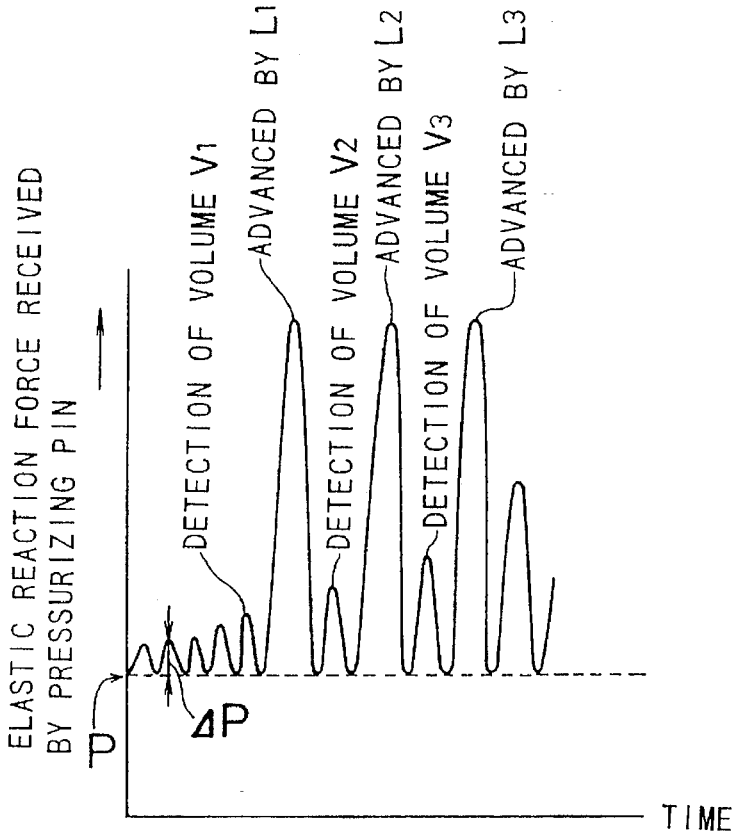
FIGS. 2(A) and 2(B) are graphs showing the reaction force received by and the stroke of a pressurizing pin.
Figure 2B:
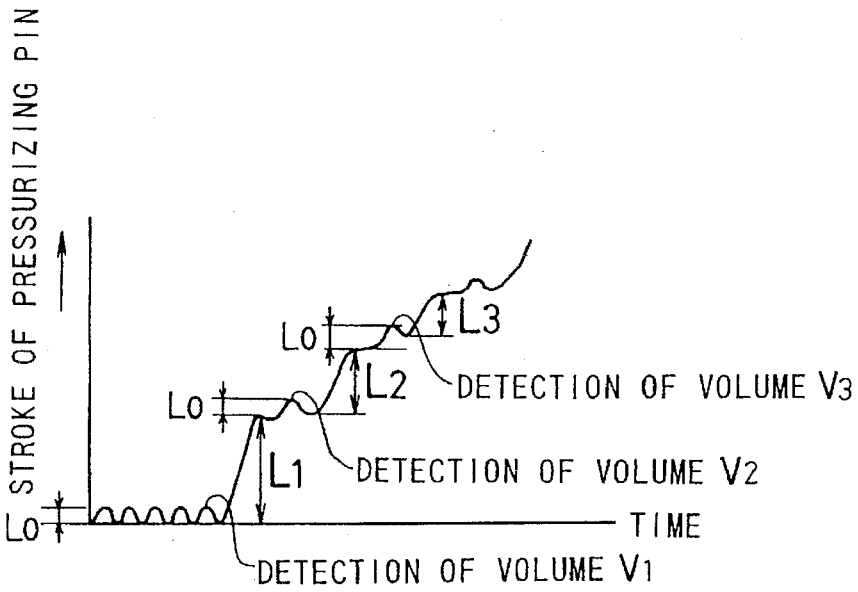
Figure 3:
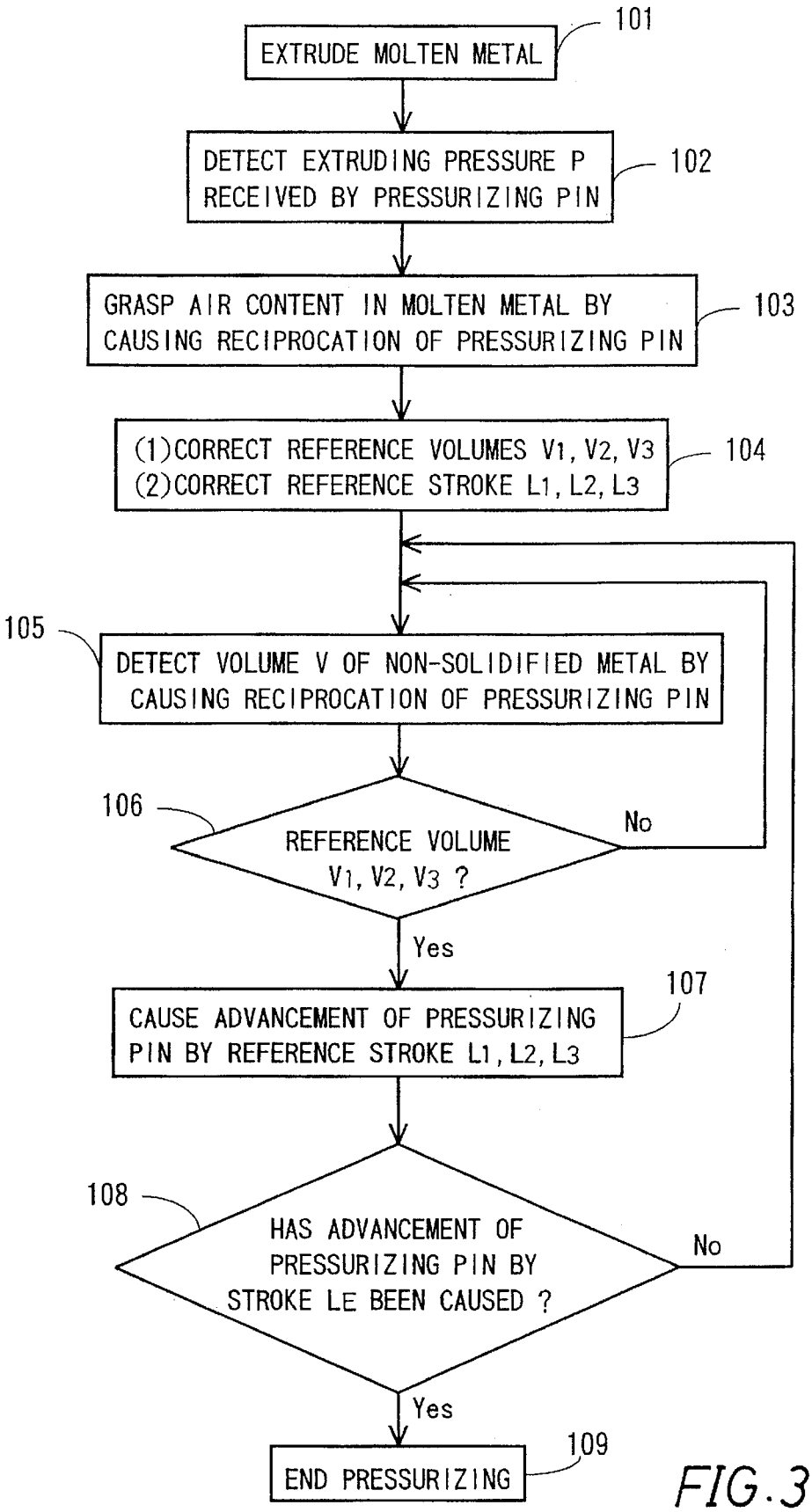
FIG. 3 is a flow chart illustrating the pressurizing pin control method according to the embodiment.

Now, the method of controlling pressurizing pin 18*p* according to the embodiment of the invention will be described with reference to FIGS. 1(A) to 1(C), 2(A), 2(B) and 3. FIGS. 1(A) to 1(C) are views illustrating the manner of replenishment for necessary locality with molten metal by the pressurizing pin 18*p* during solidification of molten metal in the die cavity 16 while undergoing shrinkage. FIG. 2(A) is a graph showing the elastic reaction force received by the pressurizing pin 18*p* from molten metal, i.e., pressure of molten metal in the cavity 16. FIG. 2(B) is a graph showing the stroke of the pressurizing pin 18*p* advanced into the cavity 16. FIG. 3 is a flow chart illustrating the embodiment of the method of pressurizing pin control. The control illustrated by the flow chart noted above is executed according to a program stored in a memory of the computer PC.

After closing of the die 13, Step 101 in FIG. 3 is executed, in which molten metal is supplied to the extruding sleeve 14*s*, and the molten metal is extruded into the cavity 16 by the plunger 14*t* which is driven by the extruding cylinder 14*p*. Then, in Step 102, the pressure received by the pressurizing pin 18*p* from molten metal, i.e., extruding pressure P, is obtained from the pressure in the first oil hydraulic chamber 181, as detected by the applied pressure sensor 20, and is stored in a memory of the computer PC. Then, in Step 103, the directional control valve 19*v* is switched to the A position at first. As a result, the pressurizing pin 18*p* is advanced. When the pressurizing pin 18*p* is advanced by a predetermined stroke $L_0$ into the cavity 16, the directional control valve 19*v* is switched to the C position to hold the pressurizing pin 18*p* at this position. With the pressurizing pin 18*p* held at this position, the reaction force is read out by the applied pressure sensor 20. A pressure increase ΔP of the reaction force from the value before movement of the pressurizing pin 18*p* by the predetermined stroke $L_0$ to the value after the movement, is stored in the memory of the computer PC. Subsequently, the pressure in the first oil hydraulic chamber 181 is reduced until the applied pressure of the pressurizing pin 18*p* and the extruding pressure P of molten metal are balanced with each other. At this time, the pressurizing pin 18*p* is retreated substantially to its initial position by the elastic reaction force of molten metal. Thus, the pressurizing pin 18*p* is reciprocated in the range of the stroke $L_0$. This reciprocation of the pressurizing pin 18*p* is represented by the first small hill in each of the graphs of FIGS. 2(A) and 2(B).

In the meantime, the molten metal that has been extruded into the cavity 16 contains air substantially in a certain ratio. When the pressurizing pin 18*p* is advanced by the predetermined stroke $L_0$ into the cavity 16, the air contained in non-solidified metal is compressed. The larger the amount of air contained in non-solidified metal, the smaller is the pressure increase ΔP, and the smaller the amount of air, the larger is the pressure increase ΔP. That is, the amount of air contained in the non-solidified metal is calculated from the pressure increase ΔP.

Since Step 103 is executed immediately after the molten metal has been charged into the cavity 16, the entire molten metal is non-solidified when Step 103 is executed. For this reason, the amount of the non-solidified metal at the time Step 103 is executed can be determined as a certain known amount. Then, the mount of air contained in the known amount of non-solidified metal is calculated from the pressure increase ΔP. Thus, in Step 103, the amount of air contained in molten metal or air contet in molten metal is calculated.

In Step 104, reference volumes $V_1$ to $V_3$ and reference strokes $L_1$ to $L_3$ to be described later, are corrected according to the air content in molten metal calculated in Step 103.

Further, in Step 105, the reciprocation of the pressurizing pin 18*p* by the stroke $L_0$ noted above is caused repeatedly for deriving the volume V of the non-solidified metal. More specifically, each time the pressurizing pin 18*p* has been advanced by the stroke $L_0$ and then held stationary, the pressure increase ΔP of the molten metal that is remaining as such without being solidified is determined from the output of the applied pressure sensor 20. As described above, the larger the amount of air contained in non-solidified metal, the smaller is the pressure increase ΔP. Since, the air content has already bee calculated in Step 103, the volume V of the non-solidified metal is calculated from this value ΔP and the air content determined in Step 103. Then, a check is made in Step 106 as to whether the volume V of the non-solidified metal has been reduced to the reference volume $V_1$. If the volume of the non-solidified metal is greater than the reference volume $V_1$, the routine goes back to Step 105 of obtaining the volume V of the non-solidified metal again by causing repeated reciprocation of the pressurizing pin 18*p* by the stroke $L_0$. Steps 105 and 106 are thus executed repeatedly during solidification of molten metal.

The second to fifth hills shown in each of the graphs of FIGS. 2(A) and 2(B) represent the process in Steps 105 and 106. FIG. 1(A) shows the positional relation of the pressurizing pin 18*p* and the cavity 16 to each other in this process.

As the solidification of the molten metal proceeds, the volume V of the non-solidified metal eventually becomes equal to the reference volume $V_1$. At this time, Step 107 is executed, in which the pressurizing pin 18*p* is advanced by the necessary stroke $L_1$ into the cavity 16. The resultant state is shown as the sixth hill in each of FIGS. 2(A) and 2(B), and the positional relation between the pressurizing pin 18*p* and the cavity 16 is shown in FIG. 1(B). The necessary stroke $L_1$ of the pressurizing pin 18*p* is set to a proper value in relation to the reference volume $V_1$ of the non-solidified metal, air content therein and shrinkage of molten metal due to solidification thereof. In other words, it is set to a stroke with which necessary molten metal replenish action can be obtained when the volume of the non-solidified metal is $V_1$. In the correction Step 104 noted above, if the air content in molten metal is rather high, the reference volumes $V_1$ to $V_3$ are set to smaller ones while the necessary strokes $L_1$ to $L_3$ for pressure application are set to greater ones. Conversely, if the air content is rather low, the reference volumes $V_1$ to $V_3$ are set to be greater while the necessary strokes $L_1$ to $L_3$ are set to be smaller.

As shown, when the volume V of the non-solidified metal has been reduced to the reference volume $V_1$, the pressurizing pin 18*p* is advanced by the necessary stroke $L_1$ into the cavity 16. Thus, only the necessary locality is efficiently replenished with molten metal, thus causing squeezing of air contained in the non-solidified metal and replenishing with molten metal corresponding to the deficiency produced with shrinkage of molten metal due to solidification thereof.

In Step 108, a check is made as to whether advancement of the pressurizing pin 18*p* by the maximum stroke $L_E$ into the cavity 16 has been caused. At the instant moment, $L_1<L_E$, and thus the routine goes back to Step 105 for calculating the volume V of the non-solidified metal from the pressure increase ΔP produced by causing repeated advancement of the pressurizing pin 18*p* by the stroke $L_0$. Then, in Step 106, a check is made as to whether the volume V of the non-solidified metal has been reduced to the reference volume $V_2$, and if the volume V of the non-solidified metal has been reduced to the reference volume $V_2$, Step 107 is executed in which the pressuring pin 18*p* is further advanced by the necessary stroke $L_2$ into the cavity 16. This operation is shown as the eighth hill in each of FIGS. 2(A) and 2(B), and the positional relation between the pressurizing pin 18*p* and the cavity 16 at this time is shown in FIG. 1(C). The necessary stroke $L_2$ of the pressurizing pin 18*p* is set to a proper value in relation to the reference volume $V_2$ of the non-solidified metal, air content therein and shrinkage of the molten metal due to solidification thereof. In consequence, only the necessary locality is efficiently replenished with molten metal, thus squeezing air contained in the non-solidified metal and making up for the deficiency of molten metal produced by the shrinkage of the molten metal caused by solidification thereof.

Again, in Step 108, the check is made as to whether advancement of the pressurizing pin 18*p* by the maximum stroke $L_E$ into the cavity 16 has been caused. This time, $L_1+L_2<L_E$, and the routine again goes back to Step 105 of calculating the volume of the non-solidified metal from the pressure increase ΔP produced by causing again the advancement of the pressurizing pin 18*p* by the stroke $L_0$. In the following Step 106, the check as to whether the volume V of the non-solidified metal has been reduced to, this time, the reference volume $V_3$ is made.

If it is found that the volume V of the non-solidified metal has been reduced to the reference volume $V_3$, the routine goes to Step 107 of causing further advancement of the pressurizing pin 18*p* by, this time, the necessary stoke $L_3$ into the cavity 16. This operation is represented by the tenth hill in each of FIGS. 2(A) and 2(B). The necessary stroke $L_3$ of the pressurizing pin 18*p* is set to a proper value in relation to the reference volume $V_3$ of the non-solidified metal, air content therein and shrinkage of the molten metal produced by solidification thereof. Consequently, only the necessary locality is efficiently replenished with molten metal, thus causing squeezing of air contained in the non-solidified metal and making up for the deficiency of molten metal produced by the shrinkage of the molten metal due to solidification.

In the manner as described above, the process of Steps 105 through 107 is executed repeatedly, and if it is found in Step 108 that advancement of the pressurizing pin 18*p* by the maximum stroke $L_E$ into the cavity 16 has been caused, Step 109 is executed. In Step 109, the directional control valve 19*v* in the oil hydraulic circuit 19 is switched to the B position to withdraw the pressurizing pin 18*p* from the cavity 16, thus ending the pressure application.

Where it is necessary to cause only a single reciprocation of the pressurizing pin 18*p* for detecting the volume V of the non-solidified metal, it is sufficient to cause the sole advancement, rather than the reciprocation, of the pressurizing pin 18*p* for detecting the volume V.

FIG. 5 shows a case of application of the above control of the pressurizing pin 18*p* to a cavity 16 which has a plurality of large thickness or depth portions.

In this case, in Step 104 the reference volumes $V_1$ to $V_3$ are set to $V_1=V_{1a}+V_{1b}+V_{1c}$, $V_2=V_{2a}+V_{2b}$ and $V_3=V_{3a}$, and the reference strokes $L_1$ to $L_3$ are set in accordance with the respective reference volumes $V_1$ to $V_3$.

When the volume V of the non-solidified metal is reduced to the reference volume $V_1$ with the progress of solidification of the molten metal charged in the cavity 16, the pressurizing pin 18*p* is advanced by the stroke $L_1$ into the cavity 16. As a result, localities $V_{1a}$ to $V_{1c}$ occupied by non-solidified metal are replenished with molten metal, thus squeezing contained air and making up for the shrinkage of molten metal.

When the volume Qf the non,solidified metal is reduced to the reference volume $V_2$ with complete solidification of the non-solidified metal locality $V_{1c}$ in the course of progress of solidification, the pressurizing pin 18*p* is further advanced by the necessary stroke $L_2$ into the cavity 16. Consequently, the non-solidified metal localities $V_{2a}$ and $V_{2b}$ are replenished with molten metal, thus causing squeezing of contained air and making up for the shrinkage of molten metal. Even if the non,solidified metal locality $V_{1c}$ has not yet been completely solidified, it is possible to operate the pressurizing pin 18*p* by the necessary stroke $L_2$ in a state that there is partitioning from the adjacent large thickness locality $V_{1a}$ by the wall of solidified metal. It is further possible to promote separation of the non-solidified metal localities $V_{1a}$ and $V_{1c}$ by positively cooling the intervening locality.

When the volume V of the non-solidified metal is reduced to the reference volume $V_3$ at which time the non-solidified metal locality $V_{2b}$ has been completely solidified, the pressurizing pin 18*p* is further advanced by the necessary stroke $L_3$ into the cavity 16. Thus, the non-solidified metal locality $V_{3a}$ is replenished with molten metal, thus squeezing contained air and making up for the shrinkage of molten metal. Even if the non-solidified metal locality $V_{2b}$ has not yet been completely solidified, it is possible to operate the pressurizing pin 18*p* by the necessary stroke $L_3$ in a state that there is partitioning from the adjacent large thickness locality $V_{2a}$ by the wall of solidified metal.

In the previous embodiment shown in FIG. 3, the volume of the non-solidified metal has been calculated from the increase ΔP of the reaction force received by the pressurizing pin 18*p* that is produced as a result of the advancement of the pressurizing pin 18*p* by a predetermined stroke into the cavity. Alternatively, it is possible to calculate the volume of the non-solidified metal from an increase of the advancement of the pressurizing pin 18*p* into the cavity that is produced by increasing the force applied to the pressurizing pin 18*p* by the cylinder 18*s* by a predetermined amount. The system of determining the increase of the reaction force by setting a fixed stroke increase and the system of determining the stroke increase by setting a fixed force increase are equivalent in principle. In the system in which a fixed force increase is set, the stroke increase becomes large with increasing volume of non-solidified metal and becomes small with reducing volume of non-solidified metal. Thus, the pressurizing pin is reciprocated while the stroke increase is above a predetermined value and is greatly advanced when the predetermined value is reached.

What is claimed is:

1. A method of controlling a pressurizing pin introduced into a die cavity during solidification of molten metal charged in the die cavity for replenishing a locality where molten metal is being solidified, the method comprising:

a first step of repeatedly detecting a physical quantity which is a function of a volume of non-solidified metal in the die cavity; and a second step of advancing the pressurizing pin into the cavity when the physical quantity repeatedly detected in said first step reaches a value corresponding to a predetermined volume.

2. The method according to claim 1, wherein said first step comprises the step of detecting an increase of reaction force acting on the pressurizing pin when the pressurizing pin is advanced to an extent corresponding to a predetermined length.

3. The method according to claim 2, wherein, when the reaction force increase has once been detected, said first step comprises the step of restoring the pressurizing pin to a position before detection of the reaction force increase by reducing the force with which the pressurizing pin has been advanced by the predetermined length extent.

4. The method according to claim 1, wherein said first step comprises the step of detecting an increase of the advancement of the pressurizing pin that is produced when the force applied to the pressurizing pin is increased by a predetermined amount.

5. The method according to claim 4, wherein, when the advancement increase has once been detected, the first step comprises the step of restoring the pressurizing pin to a position before detection of the advancement increase by reducing the force with which the pressurizing pin has been advanced.

6. The method according to claim 1, wherein said second step comprises the step of setting said predetermined volume to a volume of one of a plurality of localities into which the non-solidified metal in the cavity is separated.

7. The method according to claim 1, wherein a plurality of cycles each constituted by said first and second steps is repeatedly carried out.

* * * * *